US008002147B2

(12) United States Patent
Wells et al.

(10) Patent No.: US 8,002,147 B2
(45) Date of Patent: Aug. 23, 2011

(54) METHOD AND APPARATUS FOR A DRIP TRAY SCREEN

(75) Inventors: Leroy Levert Wells, Converse, TX (US); Michael Troy Stuebs, San Antonio, TX (US)

(73) Assignee: Lancer Partnership, Ltd., San Antonio, TX (US)

( * ) Notice: Subject to any disclaimer, the term of this patent is extended or adjusted under 35 U.S.C. 154(b) by 584 days.

(21) Appl. No.: 12/072,875

(22) Filed: Feb. 28, 2008

(65) Prior Publication Data

US 2009/0218367 A1 Sep. 3, 2009

(51) Int. Cl.
*B67D 1/16* (2006.01)

(52) U.S. Cl. ..... 222/108; 222/1; 222/129.1; 222/146.6; 220/571; 137/312; 137/314

(58) Field of Classification Search ..... 222/108, 222/111, 1, 129.1, 129.2, 129.3, 129.4, 146.6, 222/185.1; 220/571; 137/312–314
See application file for complete search history.

(56) References Cited

U.S. PATENT DOCUMENTS 2,008,121 A * 7/1935 Armbruster ..... 222/108
2,080,923 A * 5/1937 Lassen ..... 222/131
2,594,479 A * 4/1952 Moschetto ..... 137/314
2,696,716 A * 12/1954 Marks ..... 62/286
3,327,902 A * 6/1967 Alterwitz ..... 222/108
4,194,651 A * 3/1980 Martin et al. ..... 222/108
5,063,977 A * 11/1991 Belland ..... 141/86
5,526,900 A * 6/1996 Mason ..... 184/106
5,690,138 A * 11/1997 Fuller ..... 137/312
6,189,720 B1 * 2/2001 Gillispie ..... 220/571
6,763,676 B2 * 7/2004 Jones et al. ..... 62/392
2004/0221608 A1 * 11/2004 Jablonski ..... 62/344
2005/0161065 A1 * 7/2005 Blansit et al. ..... 134/115 R
2007/0266861 A1 * 11/2007 Hart ..... 99/279

* cited by examiner

*Primary Examiner* — Frederick C. Nicolas
(74) *Attorney, Agent, or Firm* — Christopher L. Makay

(57) ABSTRACT

A drip tray trap divides a cavity of the drip tray into an inlet chamber and an outlet chamber. The trap includes perforations to permit the passage of liquids, and to restrict the movement of foreign objects and ice cubes to a drip tray outlet, thereby removing the possibility the foreign objects and ice cubes clogging a drip tray drain. The trap includes at least one angled engagement surface and at least one angled engagement surface. The angle of the engagement surfaces forces the ice cubes and foreign objects to move to lowest positions of the inlet chamber. The rerouted ice cubes melt and move through the perforations of the trap, thereby entering the outlet chamber and moving to the drip tray outlet. In a second embodiment, the trap includes handling features to facilitate the insertion and removal of the trap from the cavity of the drip tray for sanitizing.

33 Claims, 7 Drawing Sheets

METHOD AND APPARATUS FOR A DRIP TRAY SCREEN

BACKGROUND OF THE INVENTION

1. Field of the Invention

The present invention relates to product dispensing equipment and, more particularly, but not by way of limitation, to methods and an apparatus for eliminating blockages in a drip tray of a product dispenser.

2. Description of the Related Art

In the area of beverage dispensing, product dispenser manufacturers are forced to provide drip trays in a variety of forms both to meet operator needs, as well as to meet cleanliness requirements. Dependent upon anticipated usage at a consumer location, a product dispenser is outfitted with a draining or a non-draining drip tray. Other factors may include the type of product, the stability of the product, or the availability of an operator to cleanse the drip tray of the product dispenser. However, all drip trays require maintenance to ensure a healthy environment.

Non-draining drip trays, at a minimum, require routine monitoring to ensure that the drip tray has not been filled with drink overflows, discarded drinks, overflowing ice, as well as unwanted drinks from a nearby dispenser. A convenience store operator must be aware of the condition of the drip tray or the drip tray will overflow, thereby causing additional problems.

While draining drip trays require less supervision, draining drip trays still require monitoring, assistance, as well as cleansing. Traditional drip tray drains require cleansing on a regular basis to maintain a clean environment. Further, draining drip trays are susceptible to partial clogging which reduces flow, as well as complete clogging, which may cause a flooding problem.

Conventional in-line strainers or traps are often utilized in draining drip trays to keep unwanted substances from entering a drain line. However, this type of strainer or trap does not account for the build up of unwanted or misdelivered ice in the drip tray. Ice cubes, or partial cubes, tend to move toward the drain, often partially entering a drain port and partially stopping the flow.

Further problems with the in-line strainers include the collection of foreign objects at the in-line strainer/trap. The build up of ice and foreign objects in the in-line strainer create a situation of a reduced flow through the in-line strainer/ trap, and can accumulate to the point of complete blockage, thereby creating additional issues as fluids will build up in the drip tray.

In cases where no strainers are utilized, the foreign objects may pass through some portions of the drain, get stuck down line, and then create a drain blockage downstream.

Accordingly, a drip tray trap that eliminates the issues of drip tray draining would be beneficial to beverage dispensing operators, the public, as well as beverage dispenser manufacturers.

SUMMARY OF THE INVENTION

In accordance with the present invention, a drip tray trap divides a cavity of the drip tray into an inlet chamber and an outlet chamber. The trap includes perforations to permit the passage of liquids, and to restrict the movement of foreign objects and ice cubes to a drip tray outlet, thereby removing the possibility the foreign objects and ice cubes clogging a drip tray drain.

In a first embodiment, the trap includes two angled engagement surfaces and a crest disposed between the angle engagement surfaces. The angled engagement surfaces force the ice cubes and foreign objects to move downward, and away from, the drip tray outlet. The rerouted ice cubes remain in the inlet chamber, melt, and then move through the perforations of the trap to gain access to the outlet chamber and the drip tray outlet.

In an extension of the drip tray trap, the trap includes a single engagement surface that spans the entire drip tray. In this extension of the preferred embodiment, the drip tray includes an outlet at one end, and the trap angles downward from above the outlet to a floor of the drip tray.

In a second extension of the drip tray trap, the drip tray includes a well for the collection of fluids, and an outlet disposed within the well to facilitate the removal of fluids from the drip tray.

In a second embodiment, the drip tray trap includes handling features to facilitate the insertion and removal of the trap from the cavity of the drip tray for sanitizing. In this second embodiment, the handling features are brackets welded to the trap.

In an extension of the second embodiment, the handling features are integral to the trap.

In a second extension of the second embodiment, the handling features are removable, and the trap includes access points for engagement with the separate handling features.

It is therefore an object of the present invention to provide a trap tray trap for separating the drip tray into an inlet chamber and an outlet chamber, wherein the trap filters foreign objects and ice cubes.

It is a further object of the present invention to provide handling features for drip tray trap.

It is still further an object of the present invention to provide a method of filtering objects entering the drip tray to eliminate the possibility of clogging a drip tray drain.

It is still yet further an object of the present invention to provide a trap that is removable for sanitizing.

Still other objects, features, and advantages of the present invention will become evident to those of ordinary skill in the art in light of the following. Also, it should be understood that the scope of this invention is intended to be broad, and any combination of any subset of the features, elements, or steps described herein is part of the intended scope of the invention.

DETAILED DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. It is further to be understood that the figures are not necessarily to scale, and some features may be exaggerated to show details of particular components or steps.

Figure 1:
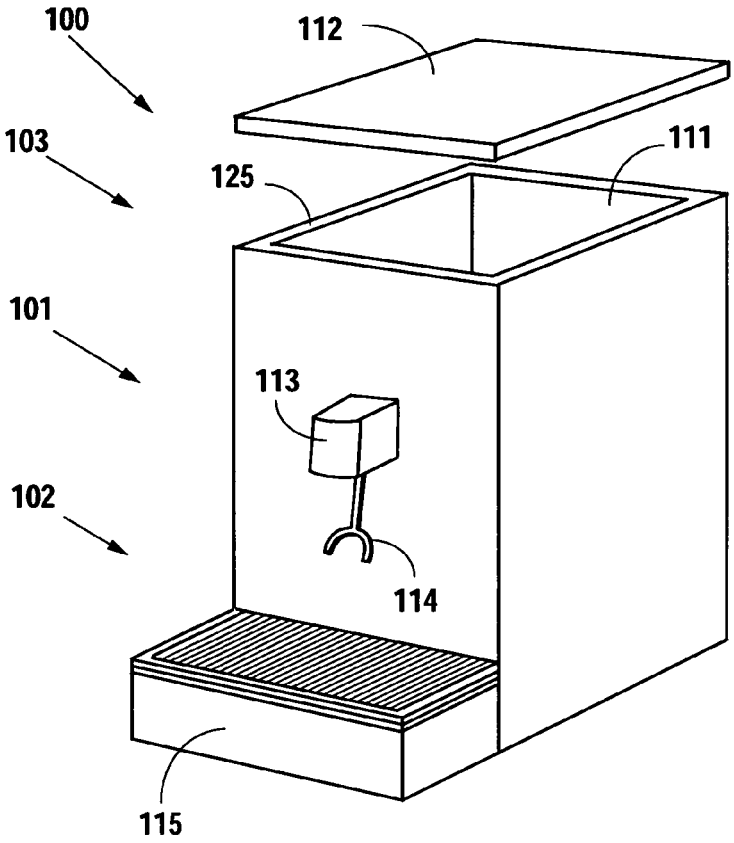
FIG. 1 provides a perspective view of a product dispenser according to a first embodiment.
Figure 2:
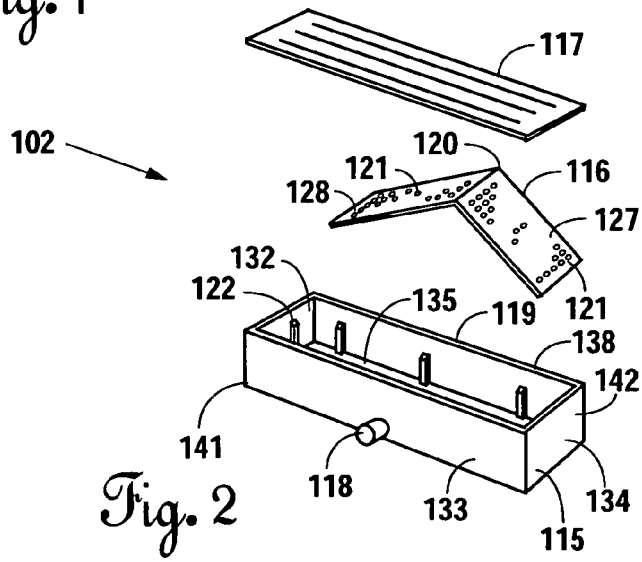
FIG. 2 provides an exploded view of a drip tray according to the first embodiment.
Figure 3A:
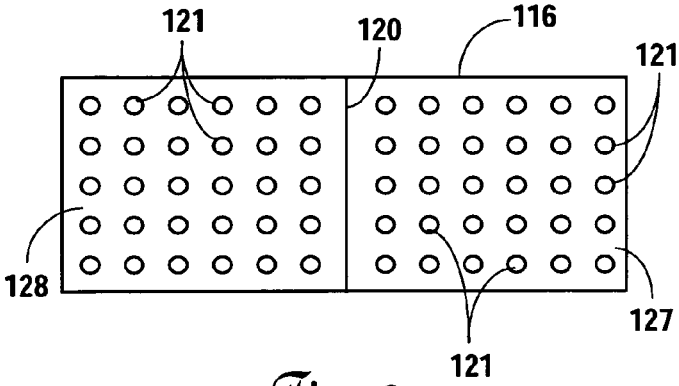
FIG. 3*a* provides a top view of a drip tray trap according to the first embodiment.
Figure 4A:
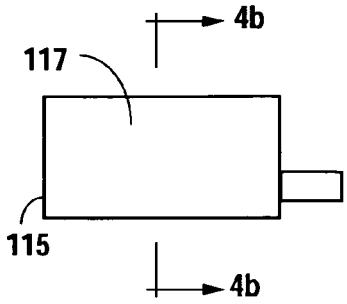
FIG. 4*a* provides a right side view of a drip tray according to the first embodiment.
Figure 3B:
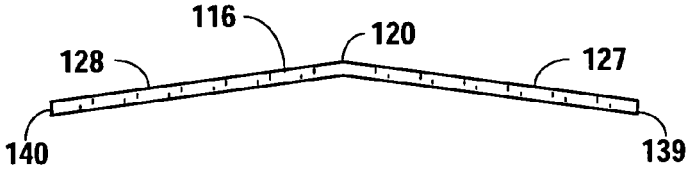
FIG. 3*b* provides a front view of the drip tray trap according to the first embodiment.
Figure 4B:
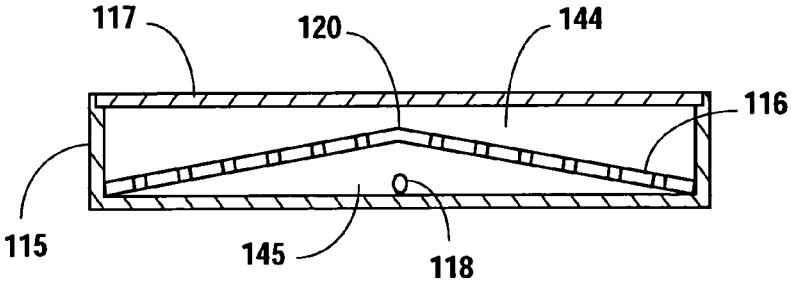
FIG. 4*b* provides a section view of the drip tray according to the first embodiment.

As shown in FIGS. 1-2, a product dispenser 100 includes a housing 101 and a drip tray assembly 102. The housing 101 includes a product dispensing circuit 103 extending from a storage chamber 111 to an external dispensing chute 113. One of ordinary skill in the art will recognize that many forms of components in the product dispensing circuit 103 are possible, including paddlewheels, rotating trays, and the like. In this invention, a paddlewheel utilized to move product through the product dispensing circuit. This invention is suitable for use with virtually all forms of product dispensing components. The storage chamber 111 is disposed within the housing 101, and includes a port 125 for filling the chamber 111. The storage chamber 111 is insulated to store and thermally isolate the product disposed within the storage chamber 111. In this disclosure, the product utilized is ice, and the insulated walls provide prolonged ice life. The product dispenser 100 further includes a lid 112 of a size complementary to the port 125, such that the lid 112 closes out the storage chamber 111. The product moves to an external dispensing chute 113 substantially centrally disposed on a front of the housing 101. The product dispenser 100 further includes an actuator 114 disposed beneath the external dispensing chute 113, such that an operator may push on the actuator 114 with a receptacle and receive a portion of the product disposed within the storage chamber 111.

The drip tray assembly 102 includes a tray 115, a trap 116, and a cup rest 117. The tray 115 includes first through fourth walls 131-134 disposed vertically and a floor panel 135 that form a tray capable of holding fluids as well as solid products. The tray further includes a first end 141 and a second end 142. The floor panel 135 is disposed horizontally and connects to each of the walls 131-134 to create a tray having an interior cavity 119 with an inlet 138. The tray 115 may be formed from virtually any material that is compatible with beverages resists corrosion. Illustratively, in this first embodiment, the tray 115 is formed from acetal butyl styrene. The tray 115 may further include a drain port 118 disposed in a wall 133 nearest the product dispenser 100 or in the floor panel 135. In this particular example, the drain port 118 includes a fitting for attaching to a disposal system (not shown), such as a sewer system or septic system. Accordingly, when the drain port 118 is attached to a permanent disposal system, fluids disposed within the cavity 119 of the tray 115 flow through the drain port 118 to the disposal system.

The tray 115 may further include cup rest supports 122. The cup rest supports 122 are disposed within the interior cavity 119 and, in this injection-molded example, the cup rest supports 122 are integrally formed with the tray 115, and extend upward from the floor 135 to a point in close proximity to the inlet 138 of the cavity 119. However, one of ordinary skill in the art will readily recognize that the cup rest supports 122 may be formed separately from the tray 115. The cup rest supports 122 provide support to the cup rest 117, as well as any drink receptacles disposed on top of the cup rest 117, and, accordingly, must be of a height suitable for registering an upper surface of the cup rest 117 at a predetermined height.

Alternatively, in a sheet metal version of the tray 115, the cup rest 117 may fit on an inner ledge, and, therefore, cup rest supports 122 would not be required.

The trap 116 is a formed sheet metal component, and of a shape complementary to the floor panel 135. The trap 116 includes a first end 139, a second end 140, a first engagement surface 127, a second engagement surface 128, and perforations 121. The trap 116 is of a sheet-metal gauge sufficient to provide rigidity, thereby maintaining the formed shape. In this particular example, the trap 116 is formed from stainless steel sheet, such that the first engagement surface 127 and the second engagement surface 128 are disposed at an angle of approximately one degree, thereby creating a crest 120 substantially centrally disposed between the first and second engagement surfaces 127-128, as well as between the first and second ends 139-140. The first and second engagement surfaces 127-128 further include perforations 121 of a predetermined size disposed in a predetermined arrangement. In this particular example, the perforations 121 are apertures arranged in a repeating pattern. However, one of ordinary skill in the art will recognize that a variety of shapes and shape arrangements are possible, dependent upon the application, and are considered within the scope of this invention.

The cup rest 117 is commonly known in the industry, and is utilized to span the inlet 138 of the cavity 119 and support drink receptacles. Accordingly, the cup rest 117 is disposed on the cup rest supports 122 in a substantially level orientation.

On assembly, the trap 116 is placed into the interior cavity 119 of the tray 115, such that the crest 120 is nearest the inlet 138 of the cavity 119. In this arrangement, the crest 120 of the trap 116 is disposed above the drain port 118. As the trap 116 is complementary in shape to the floor panel 135, the trap 116 divides an inner volume of the cavity 119 into two chambers. An inlet chamber 144 is disposed above the trap 116, and an outlet chamber 145 is disposed beneath the trap 116. On further assembly, the cup rest 117 is placed onto the cup rest supports 122 or the support ledge, as dictated by the type of material utilized in the formation of the tray 115. At this point, the drip tray assembly 102 may be placed onto the product dispenser housing 101 such that the drain port 118 faces the housing 101 or protrudes from the floor when the tray 115 is properly registered on suitable tray supports. Once properly oriented and installed, the drain port 118 may be connected to a suitable disposal system.

In use, the product dispenser 100 receives a product through the port 125 of the storage chamber 111. The product remains in the chamber 111 until a dispense signal is delivered by depressing the actuator 114. Upon activation, the product dispensing circuit 103 delivers a portion of the product disposed within the storage chamber 111 through the external dispensing chute 113. If an operator has placed a drink receptacle beneath the external dispensing chute 113, the dispensed portion of the product is dispensed into the drink receptacle. If the operator has misplaced or neglected to place his receptacle beneath the external dispensing chute 113, he may catch only a portion of the dispensed amount of product, and the balance of the dispensed portion falls onto the cup rest 117.

In this particular example, the product is ice. As the cup rest 117 typically is constructed from a grating or other porous configuration sufficient for supporting a receptacle, the ice passes through the cup rest 117 and through the inlet 138 of the tray 115, thereby entering the inlet chamber 144. Ice dispensed onto the crest 120 is forced to move along the first and second engagement surfaces 127 and 128 towards a lowest potential energy, but remain within the inlet chamber 144. As such, the ice particles, cubes, and shards, move away from the crest 120 to the first and second ends 139-140 of the trap 116 and come to rest against the walls 132 and 134 of the tray 115. In this position, a greater amount of ice particle surface area is exposed to ambient conditions, and therefore melts at an increased rate. The ice melt moves through the perforations 121 to the outlet chamber 145 disposed beneath the trap 116. The fluids then exit the outlet chamber 145 through the drain port 118 en route to the suitable disposal system.

The trap 116 further restricts the movement of foreign objects through the tray 115 and into the disposal line. The sizes of the perforations 121 forces larger objects to remain in the inlet chamber 144. The objects move toward the first and second ends 139-140 of the trap 116, thereby leaving the drain path in proximity to the crest 120 clear, as well as the drain line. Illustratively, the trap 116 ceases the flow of undesired items through the tray 115, including gum, paper straw covers, coffee stirrers, ice cubes, and the like, never reach the outlet chamber 145. Accordingly, the drain remains unobstructed for extended periods.

Figure 5:
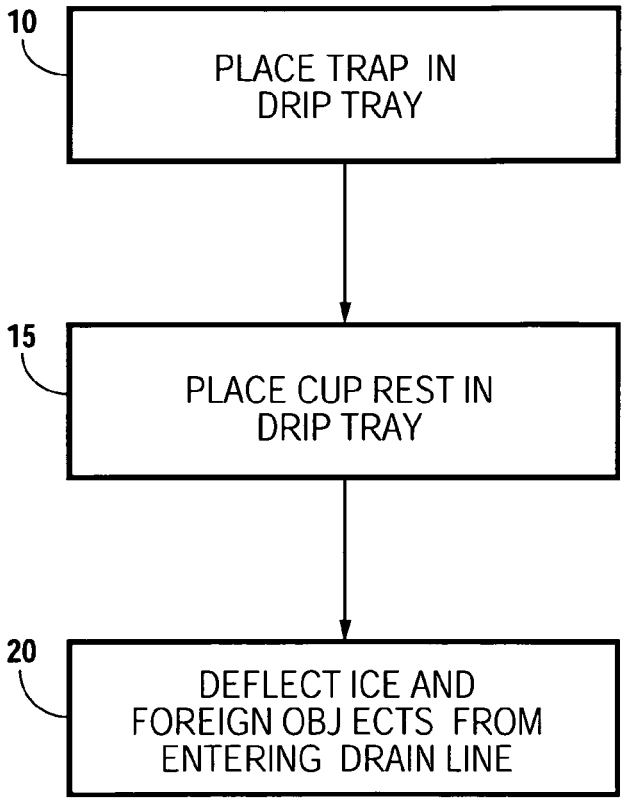
FIG. 5 provides a flowchart illustrating a method of use for the drip tray according to the first embodiment.

As shown in the method flowchart of FIG. 5, the process of using the trap 116 in a tray 115 commences with step 10, wherein an operator places the trap 116 into the tray 115 of a product dispenser 100, such that the first and second engagement surfaces 127-128 face toward the opening of the cavity 119, and the crest 120 is a highest point of the trap 116. In the installed position, the trap 116 splits the cavity 119 into an inlet chamber 144 and an outlet chamber 145. The process continues with step 15 that provides for installing a cup rest onto the drip tray 115. Step 20 provides for the trap 116 deflecting ice and foreign objects away from the drain path of the drip tray 115, thereby keeping the drain path free from obstruction.

In this particular example, the product is ice; however, one of ordinary skill in the art will recognize that this invention is suitable for use with virtually all products.

Figure 6A:
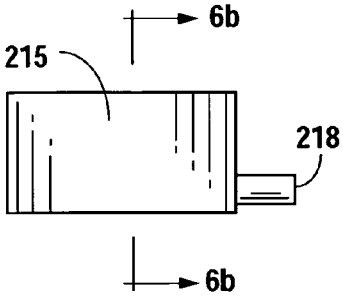
FIG. 6*a* provides a side view of a drip tray according to an extension of the first embodiment.
Figure 6B:
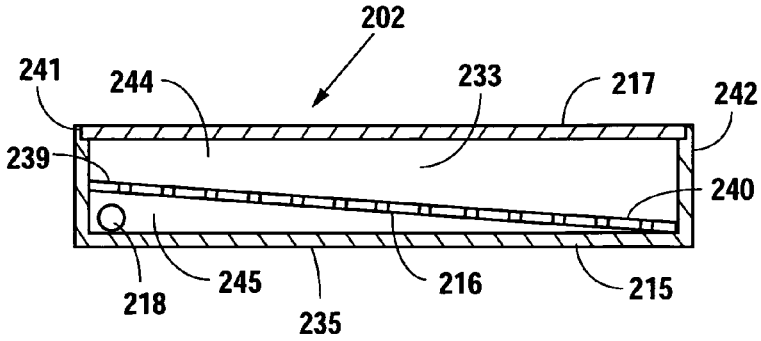
FIG. 6*b* provides a section view of the drip tray according to the extension of the first embodiment.

In an extension of the first embodiment, a drip tray assembly 202 is similar in form and function to the drip tray assembly 102; however, the drip tray assembly 202 includes a drain port 218 disposed in an alternate location. As shown in FIGS. 6*a*-6*b*, the drip tray assembly 202 includes a tray 215, a trap 216, and a cup rest 217. The tray 215 is similar in form and function to the tray 115 of the first embodiment; however, the drain port 218 is disposed within an end of a wall 233. The tray 215 further includes a first end 241 and a second end 242. One of ordinary skill in the art will recognize that the location of the drain port 218 is flexible, and based on the design of the dispenser. One of ordinary skill in the art will further recognize that the attributes of this invention are adaptable to various drain port configurations.

In this extension of the first embodiment, the drain port 218 is disposed at the first end 241 of the tray 215, as opposed to being centrally disposed within the wall 233. The trap 216 includes a first end 239, a second end 240, and a single engagement surface 227. In this configuration, the crest of the first embodiment does not exist, because there is only one engagement surface 227. The single engagement surface 227 is complementary in shape to a floor panel 235. The first end 239 is disposed nearest the drain port 218, and rests above the drain port 218 to prevent ice and foreign objects from entering the drain port 218. The second end 240 of the trap 216 is disposed on the floor of the drip tray 215 to create an angled path. As such, the cavity 219 is now divided into two chambers. An inlet chamber 244 is disposed above the trap 216, and an outlet chamber 245 is disposed beneath the trap 216. The ice cubes and foreign objects fall into the inlet chamber 244, and are forced to move down the angle of the trap 216 toward the second end 240 of the trap 216, thereby keeping the ice and foreign objects within the inlet chamber 244, and preventing ice from clogging the drain port 218.

As the ice melts, the liquid flows through the perforations 221, enters the outlet chamber 245, and flows through the drain port 218 to exit the drip tray 202.

The cup rest 217 is identical to the cup rest 117 disclosed in the first embodiment.

Operation of the product dispenser 100 utilizing the drip tray assembly 202 is substantially identical to the first embodiment, and, therefore, will not be further described.

Figure 7A:
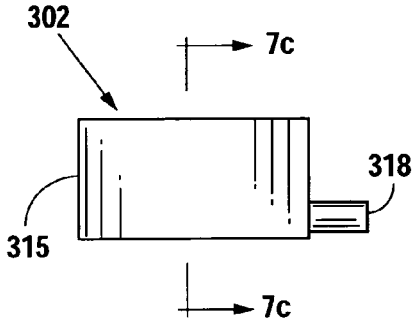
FIG. 7*a* provides a side view of a drip tray according to a second extension of the first embodiment.
Figure 7B:
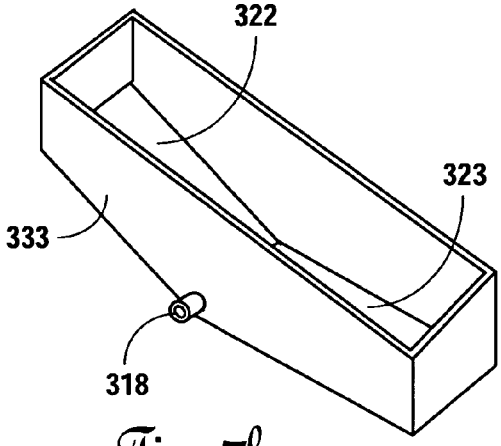
FIG. 7*b* provides an isometric view of a drip tray according to the second extension of the first embodiment.
Figure 7C:
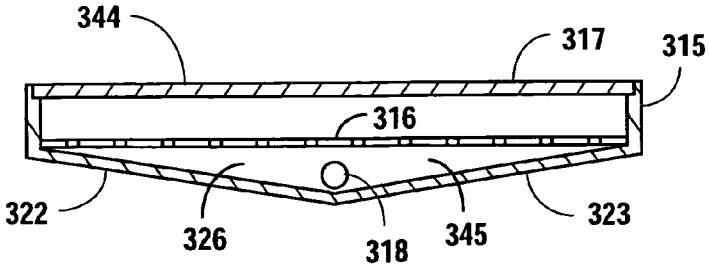
FIG. 7*c* provides a section view of the drip tray according to the second extension of the first embodiment.

In a second extension of the first embodiment, a drip tray assembly 302 is similar in form and function to the drip tray assembly 102; however, the drip tray assembly 302 includes draining features. As shown in FIGS. 7*a*-7*c*, the drip tray assembly 302 includes a tray 315, a trap 316, and a cup rest 317. The tray 315 is similar in form and function to the tray 115 of the first embodiment; however, the floor includes a first floor panel 322 and a second floor panel 323 that are disposed at a predetermined angle relative to each other, thereby forming a well 326. One of ordinary skill in the art will recognize that the location of the drain port 318 is flexible, and in this configuration, the drain port 318 is centrally disposed on the wall 333, and within the well 326 created by the first floor panel 322 and the second floor panel 323, such that fluids pool in the well 326 and may exit the tray 315 through the drain port 318.

In a second extension of the first embodiment, the trap 316 is identical to the first embodiment, and includes a first engagement surface 327, a second engagement surface 328, and a crest 320. The crest 320 is disposed between the first and second engagement surfaces 327 and 328. The first end 339 and the second end 340 of the trap 316 are disposed on the floor of the drip tray 315, such that the crest 320 is disposed above the drain port 318, thereby splitting the cavity 119 into an inlet chamber 344 and an outlet chamber 345, in similar fashion to the first embodiment. As such, ice cubes and foreign objects enter the inlet chamber 344, and are forced to move down the angled engagement surfaces 327-328 of the trap 316 toward the first and second ends 339-340 of the trap 316. The ice cubes remaining in the inlet chamber 344 until melting. Once melted, the fluid passes through the perforations 321 of the trap 316 and enters the outlet chamber 345, thereby preventing ice from clogging the drain port 318.

Operation of the product dispenser 100 utilizing the drip tray assembly 302 is substantially identical to the first embodiment, and, therefore, will not be further described. One of ordinary skill in the art will further recognize that the drip tray assemblies 102, 202, and 302 are substantially interchangeable.

Figure 8A:
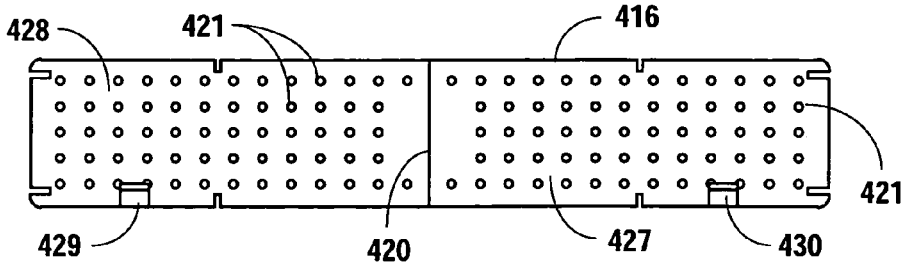
FIG. 8*a* provides a top view of a drip tray trap according to a second embodiment.
Figure 8B:
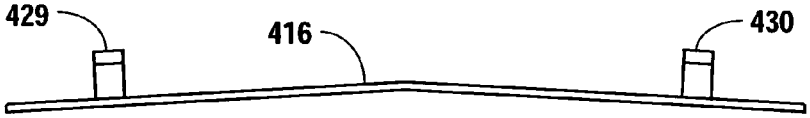
FIG. 8*b* provides a front view of the drip tray trap according to the second embodiment.
Figure 8C:
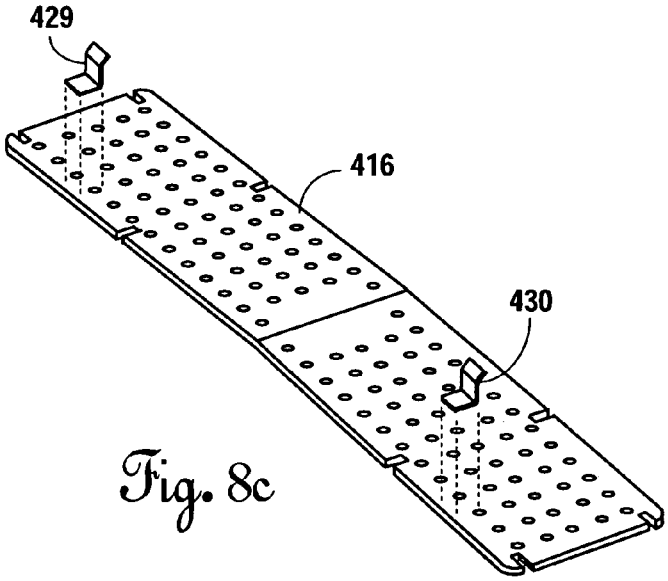
FIG. 8*c* provides a perspective view of the drip tray trap according to the second embodiment.
Figure 8D:
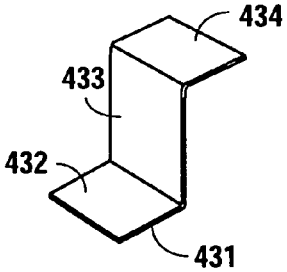
FIG. 8*d* provides a perspective view of a handling feature according to the second embodiment.

In a second embodiment, a drip tray trap similar in form and function to the trap 116 of the first embodiment includes handling features to aid an operator in the installation and removal of the trap from the drip tray. As shown in FIGS. 8*a*-8*c*, a trap 416 includes a first engagement surface 427, a second engagement surface 428, a crest 420, perforations 421, and at least one handling feature. In this particular example of the second embodiment, the trap 416 includes a first handling feature 429 and a second handling feature 430 symmetrically disposed on an upper surface of the trap 416.

The trap 416 is substantially identical in form and construction to the trap 116, and, accordingly, the trap 416 fits within the interior cavity 119 of the drip tray 115 of the first embodiment. In this particular example, the handling features 429-430 are brackets formed from sheet metal, and include a first planar segment 432, a second planar segment 433, and a third planar segment 434. The first planar segment 432 includes a mounting surface 431, and is disposed at an angle of ninety degrees relative to the second planar segment 433. The second planar segment 433 is of rectangular shape complementary to the first planar segment 432. The third planar segment 434 extends away from the second planar segment 433, and is shaped like a tab. The third planar segment 434 is disposed at approximately one hundred and twenty degrees relative to a plane of the second planar segment 433. Accordingly, when the mounting surface 431 of the handling features 429-430 is secured to another component, the second planar segment 433 stands substantially perpendicular to the attached component, and the third planar segment 434 similarly extends upward from the second planar segment 433, thereby providing a tab that may be clutched by an operator. While the first through third planar segments 432-434 have been disclosed at particular angles, one of ordinary skill in the art will recognize that other angle measurements are possible, and should be considered part of this disclosure.

In this example, the handing features 429-430 are permanently secured to the trap 416 utilizing a welding process. However, one of ordinary skill in the art will recognize that virtually any form of connection means is possible, including mechanical fasteners, adhesives, and the like.

On assembly, the first and second handling features 429-430 are secured to the trap 416 at a spacing complementary to a shoulder width of an operator. Accordingly, the operator is able to clutch a handling feature 429 or 430 in each hand, and lift the trap 416 and handling features 429 and 430 upward. Upon further assembly, the trap 416, including handling features 429 and 430, is lowered into the interior cavity 119 of the drip tray 115 in similar fashion to the first embodiment. As the trap 416 enters the interior cavity 119 first, the handling features 429-430 are disposed pointing upward, and within the interior cavity 119 of the drip tray 115. The installation process follows with the insertion of a cup rest 117 into the drip tray 115.

In use, the operator clutches at least one handling feature 429 or 430, lifts the trap 416 with the at least one handling feature 429 or 430, and inserts the trap 416 into the interior cavity 119 of the drip tray 115. The trap 416 comes to rest on the floor panel 135 of the drip tray 115, and the operator releases the at least one handling feature 429 or 430. The operator then installs the cup rest 117, if required. Once the trap 416 is installed, it deflects ice and foreign objects in similar fashion to the first embodiment.

After use, the operator removes the cup rest 117 to access the handling features 429-430 of the trap 416. The operator then removes any foreign objects screened by trap 416, grasps the handling features 429 and 430 and lifts the trap 416 out of the interior cavity 119 of the drip tray 115. The operator may then sanitize the trap 416 and handling features 429-430.

Figure 8E:
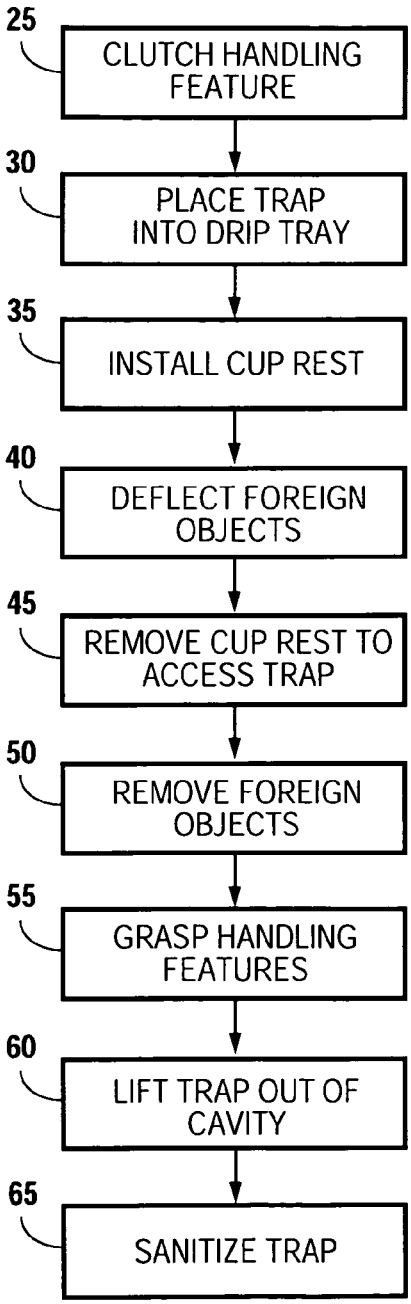
FIG. 8*e* provides a flowchart illustrating the method steps for utilizing the drip tray trap according the second embodiment.

FIG. 8*e* provides a flowchart illustrating the method steps for inserting and removing a drip tray trap 416, according to this second embodiment. Optimally, an operator grasps a handling feature 429 in each hand, as shown in step 25. The operator then moves to step 30, wherein the operator places the trap 416 into the interior cavity 119 of a drip tray 115, such that the handling features 529-530 are disposed upward. In step 35, the operator installs the cup rest 117 above the trap. Upon installation, the trap 416 deflects foreign objects and ice particles, as described in step 40. After use, the operator removes the cup rest 117 to access the trap 416, step 45. Once the cup rest 117 has been removed, the operator removes foreign objects deflected by the trap, step 50. Upon the successful removal of the foreign objects, the operator grasps the handling features 429 and 430, step 55. The operator then lifts the handling features 429 and 430, thereby lifting the trap 416 out of the interior cavity 119, step 60. Upon removal from the drip tray 115, the operator sanitizes the trap 416, step 65.

Figure 9:
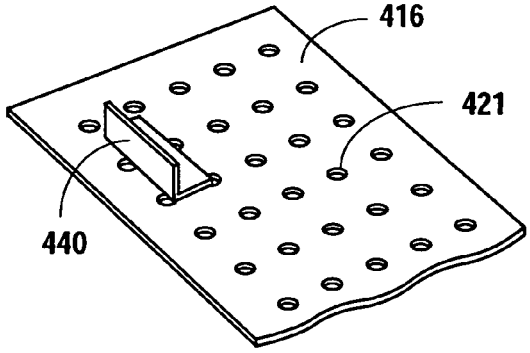
FIG. 9 provides a perspective view of an integral handling feature according to first extension of the second embodiment.

While this second embodiment has been shown with handling features that are separate components permanently mounted to the trap, one of ordinary skill in the art will recognize that the handling features integral to the trap may be created by bending up at least one tab 440 in the sheet metal trap 416, as shown in FIG. 9.

Alternatively, a trap could include access points for receiving detachable handling features. As shown in FIGS. 10*a*-10*d*, a trap 516 includes an access point 535 and a detachable handling feature 529. In this particular example, the access point 531 is a slot in the trap 516.

The handling feature 529 is similar in form to the handling features 429, and includes a first planar segment 532, a second planar segment 533, and a third planar segment 534, in similar arrangement to the handling feature 429. The handling feature 529 further includes an engagement surface 531 for engaging an underside of the trap 516 during use.

Figure 10A:
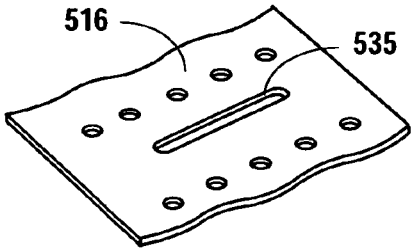
FIG. 10*a* provides a perspective view of an access point according to a second extension of the second embodiment.
Figure 10B:
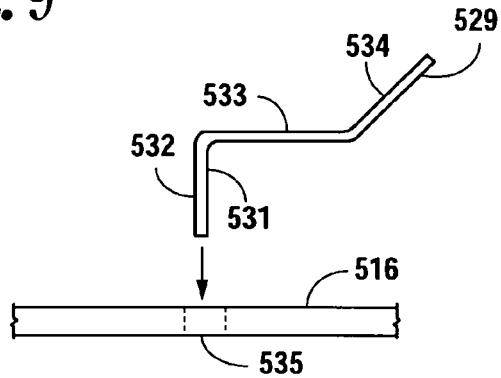
FIG. 10*b* provides a front view of a separate handling feature before being placed into the access point according to the second extension of the second embodiment.
Figure 10C:
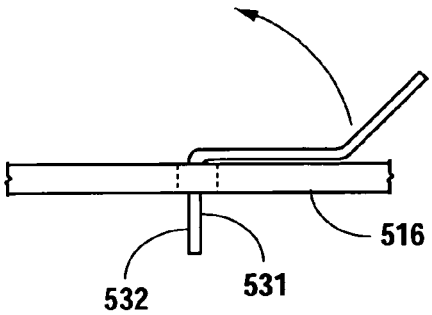
FIG. 10*c* provides a front view of a separate handling feature being placed into the access point according to the second extension of the second embodiment.
Figure 10D:
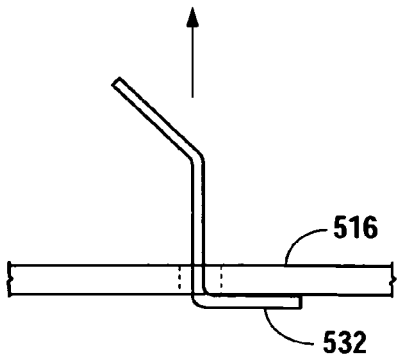
FIG. 10*d* provides a front view of a separate handling feature placed in an installed position according to the second extension of the second embodiment.

In use, the first planar segment 532 is passed through the access point 531, as shown in FIG. 10*c*. The handling feature 529 is rotated as shown in FIGS. 10*c*-10*d* such that the engagement surface 531 engages the underside of the trap 516. An operator may then lift the handling feature 529, thereby raising trap 516. Once raised, the operator is able to grasp the trap 516 for removal from a drip tray.

All other aspects of the trap 516 are similar to the previous embodiments, and, therefore, will not be further described.

While this extension of the second embodiment has been shown with a handling feature formed from sheet metal and an access point in the shape of a slot, one of ordinary skill in the art will recognize that virtually any form of handling features is possible, including formed metals, molded resins, and the like. One of ordinary skill in the art will further recognize that additional access points may be utilized to create a balanced trap removal system.

While this invention has been shown with a product dispensing circuit utilizing ice as a product, one of ordinary skill in the art will recognize that virtually any product circuit may be utilized in combination with this invention, including beverage circuits, beverage concentrates, and the like.

Although the present invention has been described in terms of the foregoing preferred embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing detailed description, rather, it is defined only by the claims that follow.

We claim:

1. A drip tray, comprising:

a tray including a cavity, the cavity in fluid communication with an inlet and a drain port; and a trap disposed within the cavity such that the trap divides the cavity into an inlet chamber in fluid communication with the inlet and an outlet chamber in fluid communication with the drain port, wherein the trap includes perforations that allow liquids to pass from the inlet chamber to the outlet chamber while preventing a flow of objects to the drain port, further wherein the trap is disposed above the drain port and angles towards a floor of the tray to create at least a first angled engagement surface that forces the objects to move along the first angled engagement surface to a lower end of the trap, thereby removing the objects from over the drain port.

2. The drip tray according to claim 1 wherein the trap is complementary in shape to a floor of the tray.

3. The drip tray according to claim 2, wherein the drain port is disposed in a wall.

4. The drip tray according to claim 3, wherein the drain port is disposed at a first end of the wall.

5. The drip tray according to claim 1, wherein the drain port is disposed within the floor of the cavity.

6. The drip tray according to claim 3, wherein the drain port is centrally disposed in the wall.

7. The drip tray according to claim 1, wherein the trap includes a second engagement surface disposed at an angle relative to the first engagement surface, thereby forming a crest between the first engagement surface and the second engagement surface.

8. The drip tray according to claim 7, wherein the crest is disposed near the drain port.

9. The drip tray according to claim 8, wherein the crest is disposed above the drain port to prevent a passage of objects from the inlet chamber to the drain port.

10. The drip tray according to claim 9, wherein the angle of the engagement surfaces deflects the objects down the engagement surfaces to a lower potential energy position.

11. The drip tray according to claim 3, further comprising a well for pooling fluids disposed within the tray.

12. The drip tray according to claim 11, wherein the trap includes a second engagement surface disposed at an angle relative to the first engagement surface, thereby forming a crest between the first engagement surface and the second engagement surface.

13. The drip tray according to claim 12, wherein the crest is disposed above the drain port, thereby preventing the objects from moving from the inlet chamber to the drain port.

14. The drip tray according to claim 13, wherein the crest deflects the objects down the angled engagement surfaces.

15. The drip tray according to claim 14, wherein the objects are ice cubes.

16. The drip tray according to claim 15, wherein the ice in the inlet chamber melts and moves through the perforations of the trap to the outlet chamber, thereby gaining access to the drain port and exiting the tray.

17. The drip tray according to claim 1, wherein a first end of the trap is disposed above the drain port, and a second end of the trap is disposed on the floor of the tray.

18. The drip tray according to claim 1, wherein the objects are ice cubes.

19. The drip tray according to claim 18, wherein the ice in the inlet chamber melts and moves through the perforations of the trap to the outlet chamber, thereby gaining access to the drain port and exiting the tray.

20. The drip tray according to claim 5, wherein the trap includes a second engagement surface disposed at an angle relative to the first engagement surface, thereby forming a crest between the first engagement surface and the second engagement surface.

21. The drip tray according to claim 20, wherein the crest is disposed near the drain port.

22. The drip tray according to claim 5, wherein a first end of the trap is disposed above the drain port, and a second end of the trap is disposed on the floor of the tray.

23. The drip tray according to claim 1, further comprising:

at least one handling feature disposed on the trap, wherein an operator grasps the at least one handling feature and lifts the trap out of the drip tray.

24. The drip tray according to claim 1, further comprising:

a cup rest disposed at the inlet of the cavity to support drink receptacles.

25. A product dispenser, comprising:

a housing including at least one product dispensing circuit;

a tray disposed on the housing, the tray including a cavity in communication with an inlet and a drain port; and a trap disposed within the tray such that the trap divides the cavity into an inlet chamber in communication with the inlet and an outlet chamber in communication with the drain port, wherein the trap includes perforations that allow a flow of fluids from the inlet chamber to the outlet chamber while preventing a movement of objects from the inlet chamber to the outlet chamber, further wherein the trap is disposed above the drain port and angles towards a floor of the tray to create at least a first angled engagement surface that forces the objects to move along the first angled engagement surface to a lower end of the trap, thereby removing the objects from over the drain port.

26. The product dispenser according to claim 25, further comprising:

a second product dispensing circuit disposed within the housing for the delivery of a beverage or beverage concentrate.

27. The product dispenser according to claim 25, wherein the product is ice.

28. The product dispenser according to claim 25, further comprising:

at least one handling feature disposed on the trap, wherein an operator grasps the at least one handling feature when installing and removing the trap.

29. A method of filtering a drip tray, comprising:

a. providing a drip tray of a product dispenser, the drip tray including a cavity in fluid communication with an inlet and a drain port;

b. placing a trap into the cavity, wherein the trap divides the cavity into an inlet chamber in communication with the inlet, and an outlet chamber in communication with the drain port;

c. directing objects entering the inlet of the cavity down an angled engagement surface of the trap, thereby restraining the objects within the inlet chamber, and allowing fluids entering the inlet chamber to move through the perforations of the trap, thereby entering the outlet chamber enroute to the drain port.

30. The method of filtering a drip tray of a product dispenser according to claim 29, further comprising:

d. allowing frozen objects in the inlet chamber to melt; and e. allowing the melted objects to pass through the perforations to the outlet chamber, thereby gaining access to the drain port.

31. The method of filtering a drip tray of a product dispenser according to claim 29, further comprising:

d. removing the objects restrained in the inlet chamber of the drip tray from the drip tray, thereby eliminating drain clogging potential.

32. The method of filtering a drip tray according to claim 29, wherein steps b. and c. are replaced with:

b. placing a trap into the cavity, wherein the trap divides the cavity into an inlet chamber in communication with the inlet, and an outlet chamber in communication with the drain port, and further wherein the trap include at least one handling feature for engaging the trap;

c. directing objects entering the inlet of the cavity down an angled engagement surface of the trap, thereby restraining the objects within the inlet chamber, and allowing fluids entering the inlet chamber to move through the perforations of the trap, thereby entering the outlet chamber en rout to the drain port;

d. removing the objects restrained in the inlet chamber of the drip tray from the drip tray, thereby eliminating drain clogging potential;

e. grasping the at least one handling feature and removing the trap from the cavity of the drip tray; and f. sanitizing the trap while removed from the drip tray.

33. A drip tray assembly, comprising:

a tray including a cavity having an inlet and a drain port; and a trap disposed within the cavity, wherein the trap includes perforations that allow a passage of fluids to the drain port, further wherein the trap is disposed above the drain port and angles towards a floor of the tray to create at least a first angled engagement surface that forces objects to move along the first angled engagement surface to a lower end of the trap, thereby removing the objects from over the drain port.

* * * * *